United States Patent [19]

Morinaga

[11] 4,400,857

[45] Aug. 30, 1983

[54] SEAT BELT BUCKLE

[75] Inventor: Masaru Morinaga, Yamato, Japan

[73] Assignee: NSK - Warner KK, Tokyo, Japan

[21] Appl. No.: 268,830

[22] Filed: Jun. 1, 1981

[30] Foreign Application Priority Data

Jun. 11, 1980 [JP] Japan ..... 55-81519[U]

[51] Int. Cl.[3] ..... A44B 11/26; A44B 19/00

[52] U.S. Cl. ..... 24/230 A; 24/230 AL

[58] Field of Search ..... 24/230 A, 230 AL

[56] References Cited

U.S. PATENT DOCUMENTS 4,027,362 6/1977 Hart et al. ..... 24/230 AL 4,262,396 4/1981 Koike ..... 24/230 AL

*Primary Examiner*—Hugh R. Chamblee

*Attorney, Agent, or Firm*—Lane, Aitken & Kananen

[57] ABSTRACT

The specification describes a push-button type seat belt buckle whose tongue releasing push-button, when mounted on a vehicle, faces toward the passenger and is located in a somewhat sunken position, thereby to facilitate the release of the tongue while avoiding accidental release thereof due to unintentional contact of the passenger to the push-button. The tongue defines in a preferred embodiment a latch hole on its longitudinal central axis, with which latch hole a latch member engages for holding the tongue in a buckle body. Since the area of contact between the tongue and latch member is rather large, it is possible to use a rather thin tongue which contributes to the weight reduction of the buckle.

7 Claims, 4 Drawing Figures

SEAT BELT BUCKLE

BACKGROUND OF THE INVENTION

1. Field of the Invention

The present invention relates to a buckle for a seat belt provided mainly in vehicles, and more particularly, to a seat belt buckle whose release push-button faces toward the passenger when mounted.

2. Description of the Prior Art

Vehicles are now equipped with a seat belt for protection of the passenger in case of emergency, for example, against collision, and various seat belt buckles have heretofore been proposed. For example, there have been proposed the so-called push-button type buckles such as those disclosed in U.S. Pat. No. 4,027,362 (except for the third and fourth embodiments illustrated in FIGS. 6 to 8) wherein a push-button movable perpendicularly to the direction of insertion of a tongue is attached to the buckle body and by operating the push-button the tongue is released from the buckle body, and the so-called slide-button type buckles such as those disclosed in U.S. Pat. No. 4,136,425 and U.S. Pat. No. 4,027,362 (only the fourth embodiment shown in FIG. 8) wherein a push-button slidable in parallel with the direction of insertion of a tongue is attached to the buckle body and by operating the slidable push-button the tongue is released from the buckle body.

However, such conventional buckles do not appear to have been constructed by taking into consideration their operationality under actual use conditions, in other words, by ignoring to a certain extent that they would be attached to a vehicle because designers were perhaps concerned too much with an improvement in performance of the buckles. That is, a buckle is usually mounted on the inner side of the lap belt (adjacent to to longitudinal center line of a vehicle), but in a push-button type buckle when mounted, the push-button operating surface faces toward the console box side, therefore it is difficult to operate the push-button for releasing the tongue from the buckle body. U.S. Pat. Nos. 3,851,360; 3,871,090 and 4,027,362 (only the third embodiment depicted in FIGS. 6 and 7) disclose each a seat belt buckle having a push-button which, when mounted, faces toward the passenger. However, many slide-button or push-button type buckles still leave room for improvement; that is, the operationality of the push-button may be good, but since the push-button is exposed, the tongue may be accidentally released when an elbow or other part of the passenger happens to touch the puch-button operating surface. In many cases, a tongue is locked by a latch member only at a portion, which is generally formed into a notch or recess along one longitudinal side of the tongue. It is thusnecessary to make the tongue rather thick in order to impart sufficient durability to the tongue, resulting in a weight increase. In some instances, for example, in the buckle illustrated in FIGS. 6 and 7 of U.S. Pat. No. 4,027,362, a releasing force is not experted perpendicularly onto the latch member from the release push-button, thereby making the release of the latch member from its corresponding tongue difficult.

SUMMARY OF THE INVENTION

It is a principal object of the present invention, in view of the above-mentioned drawbacks of the prior art buckles, to provide a buckle superior in performance such as strength and durability, wherein the push-button operating surface when mounted on a vehicle faces toward the passenger for easier operation and is rather free from accidental depression even when the passenger body touches it directly.

The present invention thus provides in one aspect a seat belt buckle including a tongue defining a hole therethrough and a buckle body, said buckle body having a base, a latch member supported on said base so as to be movable in use, between engaging and non-engaging positions with respect to said tongue and normally urged to the engaging position, an actuating member for releasing the engagement between said hole of said tongue and said latch member, said actuating member being normally urged to a non-operative position, and a casing enclosing said base, latch member and actuating member and defining a tongue insertion opening and an opening operably receiving said actuating member in a sunken position. The latter opening faces toward the passenger when mounted on a vehicle. The actuating member is slidable transversely of the direction of insertion of said tongue, and, by a sliding movement of said actuating member, the latch member is conducted to the non-engaging position for releasing the engagement thereof with said tongue.

BRIEF DESCRIPTION OF THE DRAWINGS

The present invention will now be described by way of example with reference to the accompanying drawings in which.

DETAILED DESCRIPTION OF THE PREFERRED EMBODIMENTS

Figure 1:
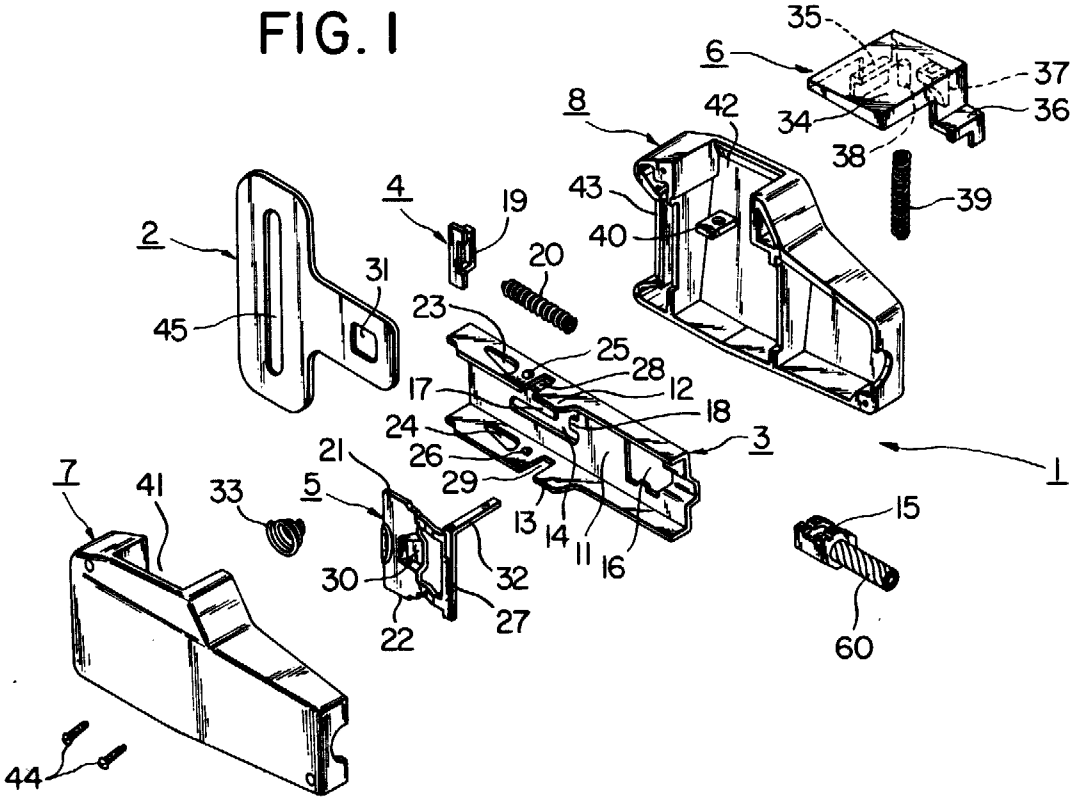
FIG. 1 is an exploded perspective view of a buckle body and its corresponding tongue, according to a first embodiment of this invention.

The buckle illustrated in FIG. 1 is composed of a buckle body 1 and a tongue 2. The buckle body 1 includes a base 3, a slider 4 for easy ejection of the tongue 2 at the time of release and for prevention of a false lock at the time of insertion of the tongue, a latch member 5 mounted on the base 3 so as to be piviotally movable generally about its front end portion (the upper left portion in the figure is assumed to be the front), a push-button 6 a release means, and right and left covers 7, 8.

The base 3 is composed of a floor 11 and side walls 12, 13 extending in parallel to the left substantially from their respective side edges of the floor 11. Through the floor 11 there are formed in order from the front toward the back a generally H-shaped hole 14, and a hole 16 for fitting therein an end portion of means 15 adapted to anchor the buckle at a desired position via a cable 60. Because of the provision of the H-shaped hole 14 there are formed opposedly projection long projection 17 and short projection 18. The slider 4 defines a through hole 19 and is fitted on the long projection 17, the slider 4 being urged forwardly by a coil spring 20. One end of the coil spring 20 is received on the rear end face of the slider 4 mounted on the projection 17 while the other end is fitted over the short projection 18. The upper edge of the hole 16 defined a notch (not shown)

whereas its lower edge presents a lug. The notch and lug cooperate with grooves formed in an end portion of the means 15 when the means 15 is force-fit in the hole 16, thereby causing the means 15 to be connected with the base 3.

Through the side walls 12 and 13 of the base 3 there are formd respectively, in order from the front to the back and in a transversely opposed manner, sectorial holes 23 and 24 for receiving edge portions 21 and 22 at front ends of the latch member 5, embossed portions 25 and 26 for preventing the tongue 2 when inserted from floating up from the floor 11, and notches 28 and 29 open to the left for allowing both ends of a bridge portion 27 at the rear end of the latch member 5 to extend outwards from the side walls 12 and 13 while guiding both ends of the bridge portion 27.

The latch member 5 is provided at an intermediate portion thereof with a latching portion 30 projecting to the right and adapted to engage a square hole 31 formed through the tongue 2 to lock the latter. The latch member 5 is further provided with an arm portion 32 extending to the right from one end of the bridge portion 27 at the rear end of the latch member 5. By means of a conical spring 33 the latch member 5 is normally biased so as to approach the floor 11 of the base 3.

The push-button 6, which is slidable transversely with respect to the base 3 while being guided by guide faces of the covers 7 and 8, is provided at the upper portion thereof with a manual operation surface 34, front and rear stopper portions 35 and 36, and further provided on the back side of the manual operation surface 34 with a cam portion 37 and a pin 38. The cam portion 37 is adapted to abut the free end of the arm portion 32 of the latch member 5 as the push-button 6 slides downwards thereby causing the latch member 5 to swing in a direction away from the floor 11 of the base 3 against the biasing force of the conical spring 33. One end of the coil spring 39 is fitted over the pin 38, while the other end is fixed onto a transverse lug 40 projecting from the inner surface of the right cover 8, thereby normally urging the push-button 6 upwards.

The right and left covers 7, 8 define in the respect upper walls thereof openings 41 and 42 for exposing in a sunken fashion the manual operation surface 34 of the push-button 6 and in the front walls tongue insertion openings (only the opening 43 is shown in the right cover 8). The left cover 7 has a portion for insertion of the front end portion of the base 3 and a portion for coupling through meshing engagement or mere joining with the corresponding portion of the right cover 8. Both covers 7, 8 are fastened together by means of a screws 44 or the like.

The tongue 2 has, in addition to the square hole 31, a long hole 45 for insertion and fixation of a webbing.

The operation of the first embodiment having the above construction will be described hereinunder.

Figure 2:
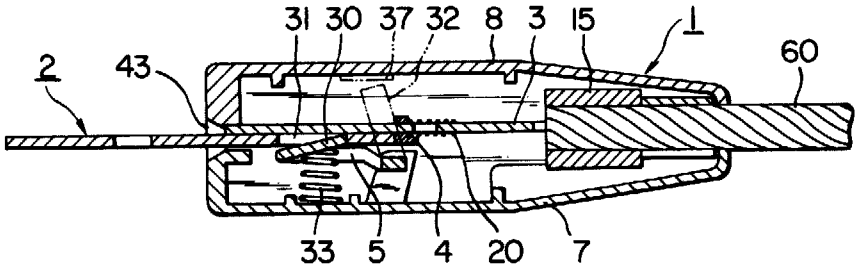
FIG. 2 is a partial cross-sectional view of the buckle body with the tongue locked therein.

FIG. 2 is a partially sectional view showing an engaged state of the tongue 2 with the latch member 5 after insertion of the tongue through the opening 43. The latch member 5 is urged in the counterclockwise direction about its front edge by the conical spring 33, with an end face of the latching portion 30 being in engagement with an engaging face of the square hole 31 of the tongue 2. In this state, the front end faces (see FIG. 1) of the edge portions 21, 22 of the latch member 5 now in abutment with the front edge portions of the sectorial holes 23, 24 of the side walls 12, 13 are positioned below the latching portion 30 of the latch member 5 now in engagement with the square hole 31 of the tongue 2, so that any effort to draw out the tongue 2 would rather result in that the latch member 5 tends to move toward a deeper engagement. Consequently, the locked state will never be released. In this state, moreover, the slider 4 is in a rearwardly slid position, with restoring force stored in the coil spring 20.

In this state, as will be apparent from FIG. 1, the push-button 6 is urged by virtue of the biasing force of the spring 39 to a position where the stopper portions 35 and 36 are in abutment with corresponding inner surfaces of the covers 7 and 8, but since the operating surface 34 is somewhat sunken in the openings 41 and 42, the push-button 6 is not likely to be depressed even when an elbow or other part of the passenger happened to contact it.

Figure 3:
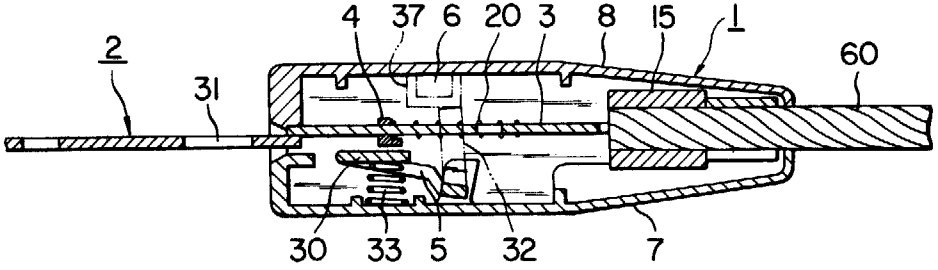
FIG. 3 is a partial cross-sectional view of the buckle body with the tongue released therefrom.

For releasing the tongue 2 from the buckle body 1, a finger force is applied onto the operating surface 34 of the push-button 6 to slide it down transversely of the tongue against the biasing force of the coil spring 39 until the cam face of the cam portion 37 of the push-button 6 abuts the free end of the arm position 32 of the latch member 5 thereby imparting clockwise torque to the latch member 5 about the front edge of the latch member 5. Consequently, the latch member 5 rotates in the clockwise direction about the front ends of the edge portions 21, 22 against the biasing force of the conical spring 33, whereby the engagement between the tongue 2 and the latch member 5 is released and at the same time the tongue 2 is ejected out of the buckle body 1 via the slider 4 by means of the coil spring 20 having a stored restoring force, as illustrated in FIG. 3.

As is apparent also from FIG. 1, since the push-button 6 is positioned at an upper part of the buckle body 1, it is easiest to operate for the passenger and its depression permits the tongue 2 to be released from the buckle body 1.

And when the force on the push-button 6 is relieved, the push-button 6 is returned to its original position by virtue of the coil spring 39, and the latch member 5 is also returned to its original position by virtue of the conical spring 33, while the slider 4 is held in the aforesaid spring-out position until the tongue 2 is inserted again, thereby maintaining the latch member 5 at a somewhat sunken position to facilitate the subsequent insertion of the tongue.

A second embodiment of the present invention will be described hereinunder wherein an arm member is provided with a latch member having a modified shape.

Figure 4:
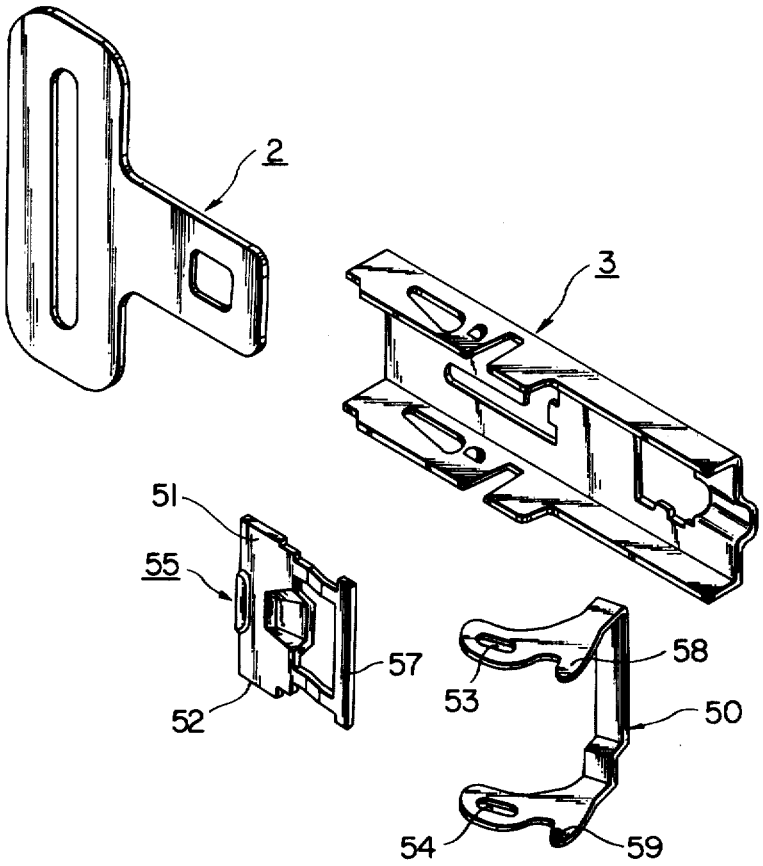
FIG. 4 is an exploded perspective view of certain parts of a buckle body and its corresponding tongue according to a second embodiment of this invention.

In this embodiment, as shown in FIG. 4, there is provided an arm member 50 which serves as the arm portion 32 of the latch member 5 of the first embodiment. The arm member 50 is mounted so as to enclose the base 3 from the right and is combined with a latch member 55 so that fitting holes 53 and 54 formed in the arm member 50 are fitted over edge portions 51 and 52 of the latch member 55 respectively and so that lugs 58 and 59 of the arm member 50 become abutment with the ends of a bridge portion 57.

The operation of the second embodiment is almost the same as that of the first embodiment. When the push-button is depressed to release the engagement between the latch member 55 and the tongue 2, both ends of the bridge portion 57 of the latch member 55 are pushed by the arm member 50 and the release operation is ensured further.

As set forth hereinbefore, the present invention is constructed so that the movement of a push-button is transmitted to a latch member through an arm portion or arm member, whereby it becomes possible to provide the operating surface of the push-button at an upper part of the buckle body when mounted on a vehicle and there is obtained a buckle wherein the push-button is easy to operate for the passenger and, since the push-button is sunken in the buckle cover, the tongue is prevented from any accidental release from the buckle body even if an elbow or other part of the passenger happens to contact it.

Furthermore, since the tongue and latch member are in a face-to-face contact with each other at the central portion of the tongue, it is possible to provide a buckle which assures form engagement, reduced deterioration of the locking function due to wear and high operational safety.

What is claimed is:

1. A seat belt buckle including a tongue defining at least one latch hole at a position remote from its outer periphery and a buckle body; said buckle body having a base, a latch member supported on said base so as to be swingable, in use, between engaging and non-engaging positions with respect to said tongue and normally urged to the engaging position, an actuating member for releasing the engagement between said latch hole of said tongue and said latch member, said actuating member being normally urged to a non-operative position, a casing enclosing said base, latch member and actuating member and defining a tongue insertion opening and an opening operably receiving said actuating member in a sunken position, and the latter opening when mounted on a vehicle facing toward the passenger so that the actuating member is slidable transversely of the direction of insertion of said tongue to the non-engaging position from the engaging position or vice versa, a latching portion of said latch member being movable substantially perpendicular to the direction of insertion of said tongue, said base being an elongated member having a central floor portion and a pair of side walls extending at right angle respectively from both sides of said floor portion, said latch member being generally of a rectangular configuration and being held swingably about the front edge thereof by said side walls, said latching portion being formed remote from said front edge and normally urged toward said floor portion of said base, said latch member including at least one arm extending substantially at right angle from the rear edge thereof toward the actuating member.

2. The seat belt buckle according to claim 1, wherein said actuating member has a cam surface which, when the actuating member is depressed, causes the latch member to swing about the front edge thereof via the arm, thereby releasing the latching portion from its engagement with the latch hole.

3. The seat belt buckle according to claim 2, wherein said latch member has an arm extending substantially at right angle from the upper end of the rear edge thereof.

4. The seat belt buckle according to claim 2, wherein said latch member has a pair of arms extending at right angle respectively from both ends of the rear edge thereof, and said arms are coupled together with a rib, whereby to enclose said base.

5. The seat belt buckle according to claim 2, 3 or 4, wherein the floor portion of said base defines an H-shaped hole whereby forming a long lug and a short lug extending toward each other, said buckle further includes a coil spring mounted on said short and long lugs and a slider slidably fitted on said long lug and normally biased forward by means of said coil spring, said slider is slid backward by said tongue upon an insertion of said tongue into said buckle body but is adapted to eject said tongue out of said buckle body when the actuating member is depressed to disengage said tongue from said latch member.

6. The seat belt buckle according to claim 2, 3 or 4 wherein the side walls of said base respectively defines backwardly-open sectorial apertures which respectively receive both ends of the front edge of said latch member, and both ends of the front edge of said latch member are located farther from the floor portion of said base than the latching position between the latch hole of said tongue and the latching portion of said latch member so as to enhance the latching state when a force is applied in a directin to pull the tongue out of the buckle body.

7. The seat belt buckle according to claim 2, 3 or 4 wherein said latch member defines a substantially rectangular opening in the vicinity of the rear edge thereof and bent stepwise in such a way that said latch member becomes more apart from the floor portion of said base toward the rear edge of said latch member, and the latching portion of said latch member protrudes from the latch member toward the floor portion of said base so as to facilitate the engagement between said latching portion and latch hole.

* * * * *